US011566844B2

(12) United States Patent
Della Negra et al.

(10) Patent No.: US 11,566,844 B2
(45) Date of Patent: Jan. 31, 2023

(54) DELIVERY DEVICE FOR BLAST FURNACE

(71) Applicant: DANIELI & C. OFFICINE MECCANICHE S.p.A., Buttrio (IT)

(72) Inventors: Angelico Della Negra, Povoletto (IT); Ilie Florian Mitoi, Bucarest (RO); Massimiliano Zampa, Udine (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 123 days.

(21) Appl. No.: 17/045,441

(22) PCT Filed: Apr. 8, 2019

(86) PCT No.: PCT/IB2019/052874
§ 371 (c)(1),
(2) Date: Oct. 5, 2020

(87) PCT Pub. No.: WO2019/197968
PCT Pub. Date: Oct. 17, 2019

(65) Prior Publication Data

US 2021/0041174 A1 Feb. 11, 2021

(30) Foreign Application Priority Data

Apr. 9, 2018 (IT) ..... 102018000004318

(51) Int. Cl.
*F24H 1/18* (2022.01)
*F24D 19/10* (2006.01)
(Continued)

(52) U.S. Cl.
CPC ..... *F27D 3/10* (2013.01); *F27B 1/20* (2013.01); *F27D 2003/0072* (2013.01)

(58) Field of Classification Search
CPC ..... F27D 3/10; F27D 2003/0072; F27D 3/14; F27B 1/20; Y10T 74/20654;
(Continued)

(56) References Cited

U.S. PATENT DOCUMENTS 4,153,140 A 5/1979 Mahr et al.
9,073,693 B2 * 7/2015 Thillen ..... F27D 3/10
(Continued)

FOREIGN PATENT DOCUMENTS

CN 204999928 1/2016
CN 204999928 U * 1/2016
(Continued)

OTHER PUBLICATIONS

English Translation of CN-204999928-U, dated Apr. 5, 2022 (Year: 2022).*
(Continued)

*Primary Examiner* — Edelmira Bosques
*Assistant Examiner* — Brett Peterson Mallon
(74) *Attorney, Agent, or Firm* — Stetina Brunda Garred and Brucker

(57) ABSTRACT

A delivery device for delivering stock material into a blast furnace includes a transition channel for the stock material, a chute for delivering the stock material, a first annular body, coaxial to and outside the transition channel, adapted to rotate about a first axis, and a second annular body, coaxial to and outside the first annular body, adapted to translate along the first axis with respect to said first annular body and/or to rotate about the first axis together with said first annular body. When the second body translates along the first axis, at least one fixed rack rotates at least one toothed wheel and a respective shaft about a second axis transversal to the first axis, thus causing a change in the inclination of the chute with respect to the first axis.

18 Claims, 7 Drawing Sheets

(51) Int. Cl.

| | |
|---|---|
| ***F24H 1/20*** | (2022.01) |
| ***F27D 3/10*** | (2006.01) |
| ***F27B 1/20*** | (2006.01) |
| ***F27D 3/00*** | (2006.01) |

(58) Field of Classification Search
CPC . Y10T 16/644; Y10T 74/1967; Y10T 74/177; F16D 2125/24; F16K 31/54; A47B 2001/105; C21B 7/20; C21B 7/18; C21B 7/205; C21B 7/00; B66B 9/06
See application file for complete search history.

(56) References Cited

U.S. PATENT DOCUMENTS

| | | | | |
|---|---|---|---|---|
| 10,697,033 | B2 * | 6/2020 | Della Negra | F27B 1/20 |
| 2012/0148373 | A1 | 6/2012 | Howell et al. | |

FOREIGN PATENT DOCUMENTS

| | | | | | |
|---|---|---|---|---|---|
| CN | 106702059 | A | * | 5/2017 | |
| GB | 2211917 | A | * | 7/1989 | F16K 31/54 |
| KR | 20030004601 | | | 1/2003 | |

OTHER PUBLICATIONS

English Translation of CN-106702059-A, dated Apr. 5, 2022 (Year: 2022).*
Patent Cooperation Treaty, International Search Report and Written Opinion for International Application No. PCT/IB2019/052874; dated Jun. 19, 2019, 12 pages.

* cited by examiner

DELIVERY DEVICE FOR BLAST FURNACE

CROSS-REFERENCE TO RELATED APPLICATIONS

This application claims priority to PCT International Application No. PCT/IB2019/052874 filed on Apr. 8, 2019, which application claims priority to Italian Patent Application No. 102018000004318 filed on Apr. 9, 2018, the disclosures of which are expressly incorporated herein by reference.

STATEMENT RE: FEDERALLY SPONSORED RESEARCH/DEVELOPMENT

Not applicable.

FIELD OF THE INVENTION

The present invention relates to a delivery device for delivering stock material into a blast furnace; it relates in particular to the tilting mechanism of the chute of such a device.

BACKGROUND ART

Stocking a blast furnace typically occurs by passing stock material through an upper opening, or inlet, of the blast furnace. The stock material generally comes from one or more supply tanks arranged above, and therefore upstream of, the upper opening of the blast furnace.

A delivery device arranged between the outlet of the supply tank and the inlet of the blast furnace is used to obtain a good delivery of the material into the blast furnace. The delivery device is provided with a central supply channel and a chute arranged downstream of the channel to deliver the stock material. The chute is arranged at the inlet of the blast furnace and can be both rotated and tilted.

The inclination of the chute is obtained by means of a tilting mechanism. Known tilting mechanisms are particularly cumbersome. Thus, the overall dimensions of the delivery device disadvantageously are affected by the dimensions of the chute tilting mechanism.

An example of known chute tilting mechanism is disclosed in document KR20030004601A.

SUMMARY OF THE INVENTION

It is an object of the present invention to make a delivery device for delivering stock material into a blast furnace, which is more compact with respect to the devices of the known art.

It is another object of the present invention to make such a device, which is more reliable with respect to the ones of the known art.

It is another object of the present invention to make such a device, which allows accurately tilting the chute.

The present invention achieves at least one of such objects and other objects which will be apparent in light of the present description, by means of a delivery device for delivering stock material into a blast furnace, the delivery device comprising:

- a transition channel for the stock material, defining a first axis Y;
- a chute for delivering the stock material, arranged below the transition channel;

- a first annular body, coaxial to and outside the transition channel, adapted to rotate about the first axis Y;
- a second annular body, coaxial to and outside the first annular body, adapted to translate along the first axis Y with respect to said first annular body and/or to rotate about the first axis Y together with said first annular body;
- at least one rack fixed to the second annular body and arranged parallel to the first axis Y;
- two shafts, having a second axis X transversal to said first axis Y, arranged on opposite sides with respect to the transition channel and crossing said second annular body and said first annular body;
- at least one toothed wheel, engaging the at least one rack and fixed to one shaft of said two shafts;

in which the chute is connected to the two shafts;

whereby, when the second annular body translates along the first axis Y, the at least one rack rotates the at least one toothed wheel and the respective shaft about the second axis X, thus causing a change in the inclination of the chute with respect to the first axis Y.

The device of the invention, although having particularly compact dimensions, advantageously allows an accurate inclination of the chute, in particular it allows the inclination of the chute to be accurately changed.

Engagement position keeping means advantageously are provided between the at least one toothed wheel and the respective rack integrally fixed to the second annular body.

The rotation and the change in the inclination of the chute advantageously can be carried out in an independent manner from each other.

The device of the invention advantageously is built so that the components thereof, in particular some bearings, are subject to minor stresses.

Further features and advantages of the invention will be more apparent in light of the detailed description of exemplary, non-limiting embodiments.

The dependent claims describe particular embodiments of the invention.

BRIEF DESCRIPTION OF THE FIGURES

Reference is made in the description of the invention to accompanying drawings, which are provided by way of a non-limiting example, in which.

The same elements, or the functionally equivalent elements, are indicated with the same numeral.

DESCRIPTION OF EXEMPLARY EMBODIMENTS OF THE INVENTION

Figure 1:
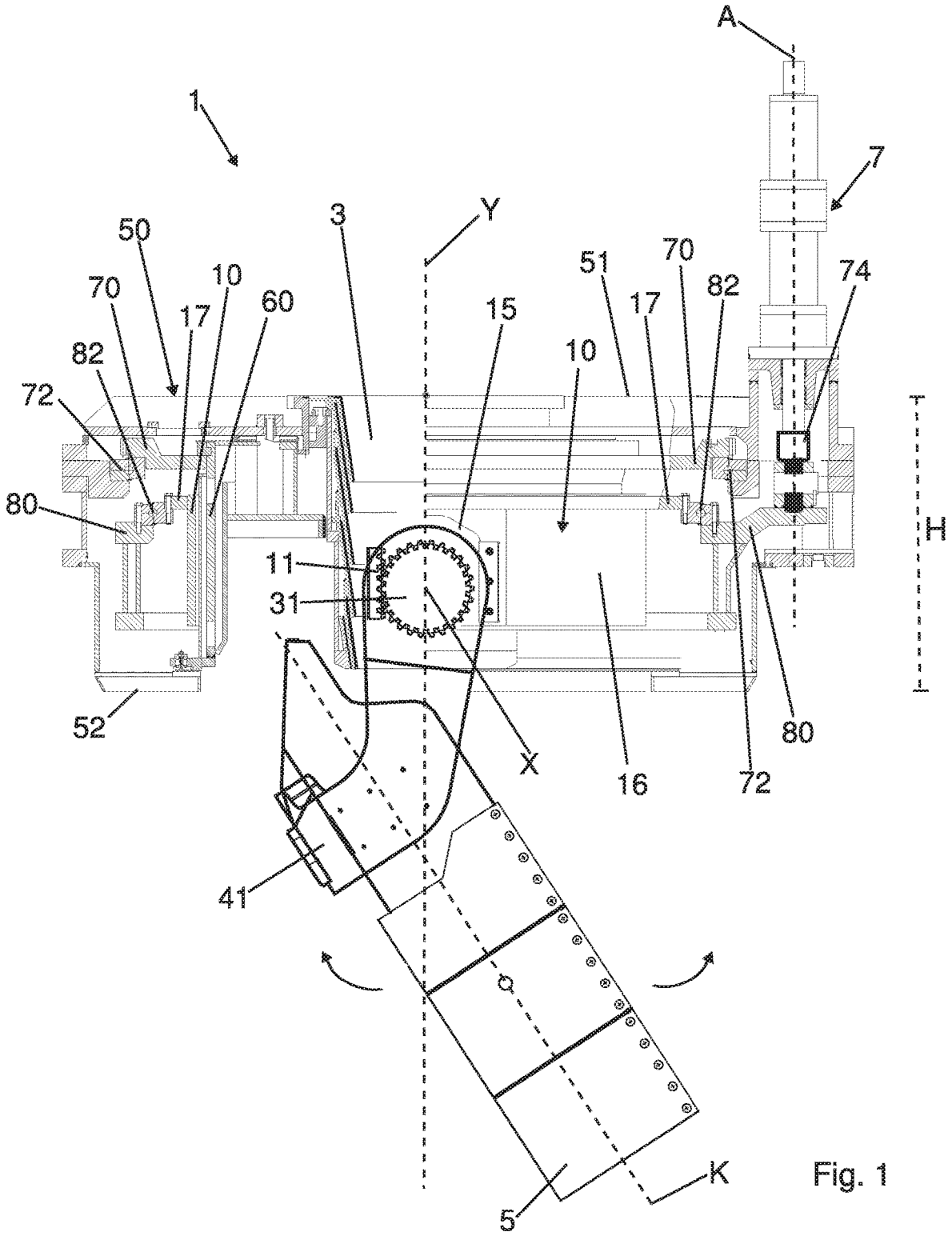
FIG. 1 shows a side view of a device according to the invention, a cross section of some parts being shown.

With reference to the drawings, a delivery device 1 for delivering stock material into a blast furnace is shown (the latter is not shown).

The delivery device 1 comprises:

- a transition channel 3 for the stock material, defining an axis Y;
- a chute 5 for delivering the stock material, arranged below the transition channel 3;
- an annular body 60, coaxial to and outside the transition channel 3, adapted to rotate about axis Y;
- an annular body 10, coaxial to and outside the annular body 60, adapted to translate along axis Y with respect to the annular body 60 and/or to rotate about axis Y together with said annular body 60;
- two racks 11, 12, fixed to the annular body 10, arranged on opposite sides with respect to the transition channel 3 and parallel to axis Y;
- two shafts 21, 22, having a same axis X, which is a rotation axis transversal to the axis Y, arranged on opposite sides with respect to the transition channel 3 and crossing the annular body 10 and the annular body 60;
- two toothed wheels 31, 32, coaxial to each other, each toothed wheel 31, 32 engaging a respective rack 11, 12 and being fixed, preferably keyed, to a respective shaft 21, 22;

in which chute 5 is directly or indirectly connected to the two shafts 21, 22, whereby, when the annular body 10 translates along the axis Y, the fixed racks 11, 12 rotate the toothed wheels 31, 32 and the respective shafts 21, 22 about the axis X, thus causing a change in the inclination of chute 5 with respect to axis Y.

The two racks 11, 12 preferably are symmetrically arranged with respect to a plane Y-Z which is orthogonal to plane X-Y, defined by the axes X and Y.

Axis Y substantially is the axis along which the stock material moves through channel 3. Axis Y preferably is a central axis of the device 1.

There are provided first actuation means 9 adapted to rotate the annular body 60 about axis Y, and with this latter also the annular body 10, and second actuation means 7 adapted to translate the annular body 10 along said axis Y.

Preferably, but not necessarily, the annular body 60 has an outer side surface provided with a plurality of longitudinal protrusions 61 which are parallel to axis Y and the annular body 10 has an inner side surface provided with a plurality of longitudinal grooves, parallel to axis Y, each longitudinal groove accommodating a corresponding longitudinal protrusion 61 so that the annular body 60 can rotate the annular body 10 when actuated by the actuation means 9.

In an alternative variant, there can be provided only one rack 11, integrally fixed to the annular body 10 and parallel to axis Y, and only one respective toothed wheel 31 engaging said rack 11 and fixed to a first shaft 21 of said two shafts 21, 22, thus at only one side, along axis X, with respect to the transition channel 3.

According to this variant, when the annular body 10 translates along axis Y, the rack 11 rotates the toothed wheel 31 and the respective shaft 21 about axis X, thus causing a change in the inclination of chute 5 with respect to axis Y. The inclination of chute 5 is made possible due to the possibility of shaft 22 rotating about axis X. The rotation of the toothed wheel 31 thus also causes the rotation of shaft 22, the chute 5 being, preferably indirectly, connected at an end of both shafts 21, 22 which is proximal to the transition channel 3. Chute 5 here acts as transmission element of the rotation from shaft 21 to shaft 22.

The delivery device of the invention advantageously can be provided with engagement position keeping means configured to always keep the engagement position of the only one toothed wheel 31 on the single fixed rack 11, or the engagement position of the two toothed wheels 31, 32 on the respective fixed racks 11, 12. This guarantee of keeping the engagement position is particularly advantageous during a roto-translation of the annular body 10, thus avoiding undesired movements between toothed wheel and respective fixed rack. In particular, it is ensured that the teeth of the toothed wheel are always adequately inserted in the respective fixed rack, also when the annular body 10 rotates around axis Y. Indeed, a loss of engagement between the toothed wheels and the respective fixed racks could occur during such a rotation.

The engagement position keeping means preferably are at least partially arranged on the annular body 10.

This results in the advantage of always ensuring the correct engagement during both the rotation movement and vertical translation movement, and especially during the changes of direction in the rotation.

Said engagement position keeping means can comprise, for example, at least one abutment slider, which is integral with the annular body 10 and adapted to oppose a reaction force component, orthogonal to the fixed rack, which is generated when the annular body 10 translates along axis Y.

Figure 7:
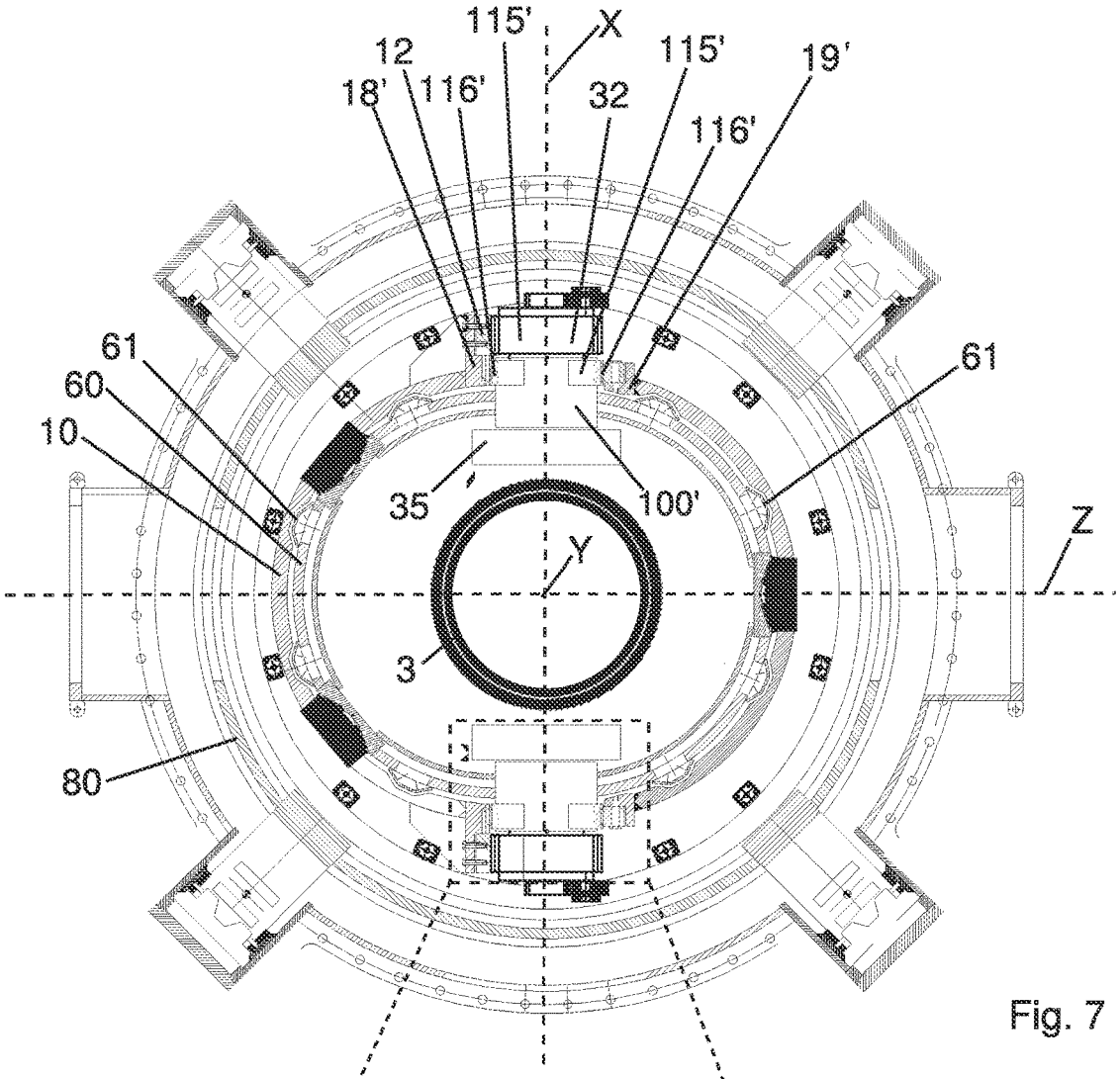
FIG. 7 shows a top sectional view of the device of the invention according to a second embodiment.
Figure 7A:
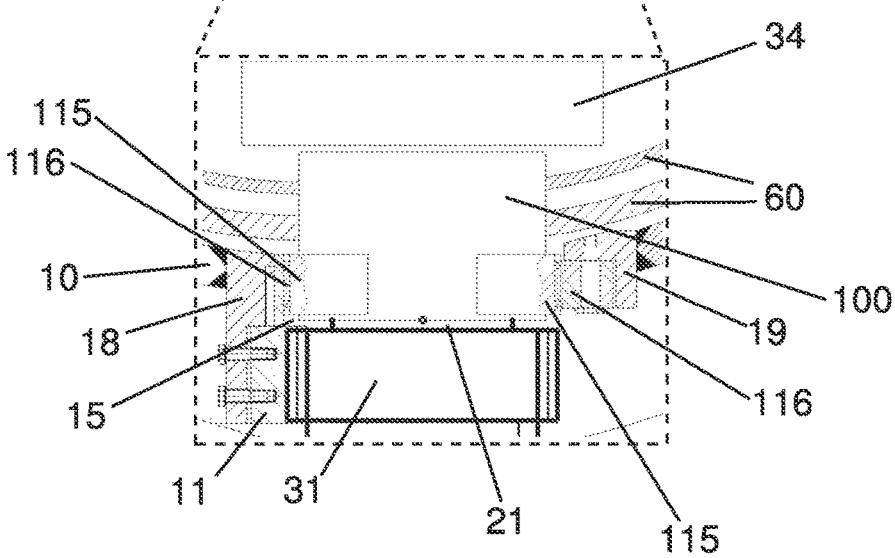
FIG. 7A shows an enlarged detail of FIG. 7.
Figure 8:
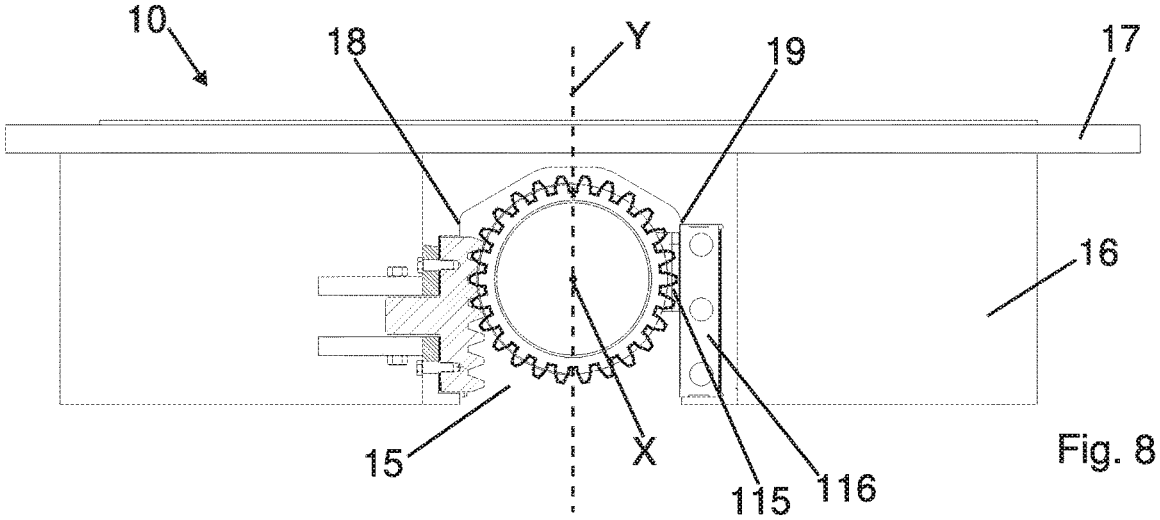
FIGS. 8 and 9 show two different configurations of part of the device of FIG. 7, corresponding to two different positions of the chute.
Figure 8A:
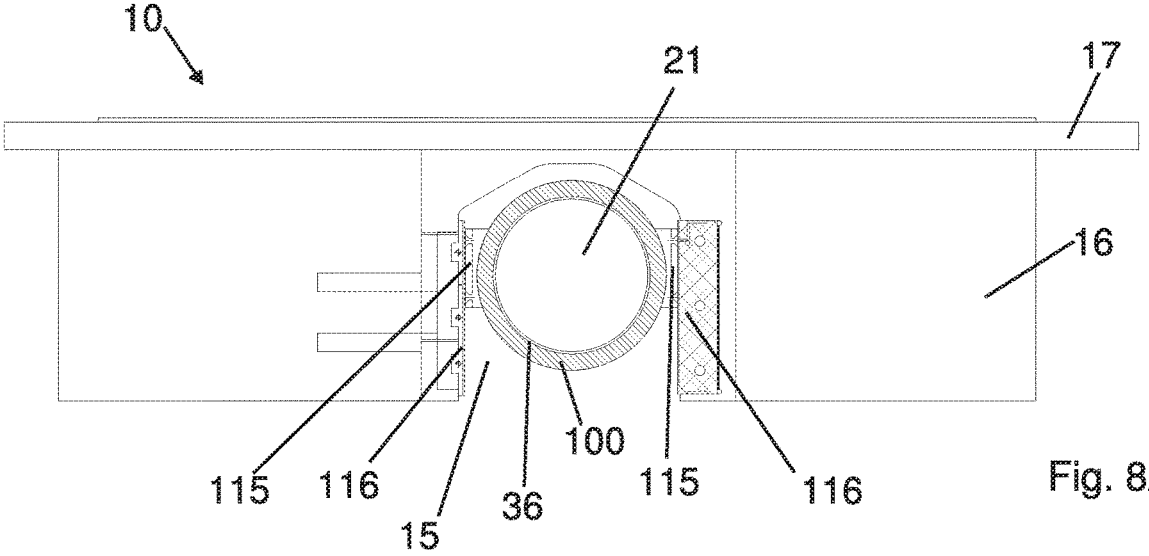
FIG. 8A shows a section of the device shown in FIG. 8.
Figure 9:
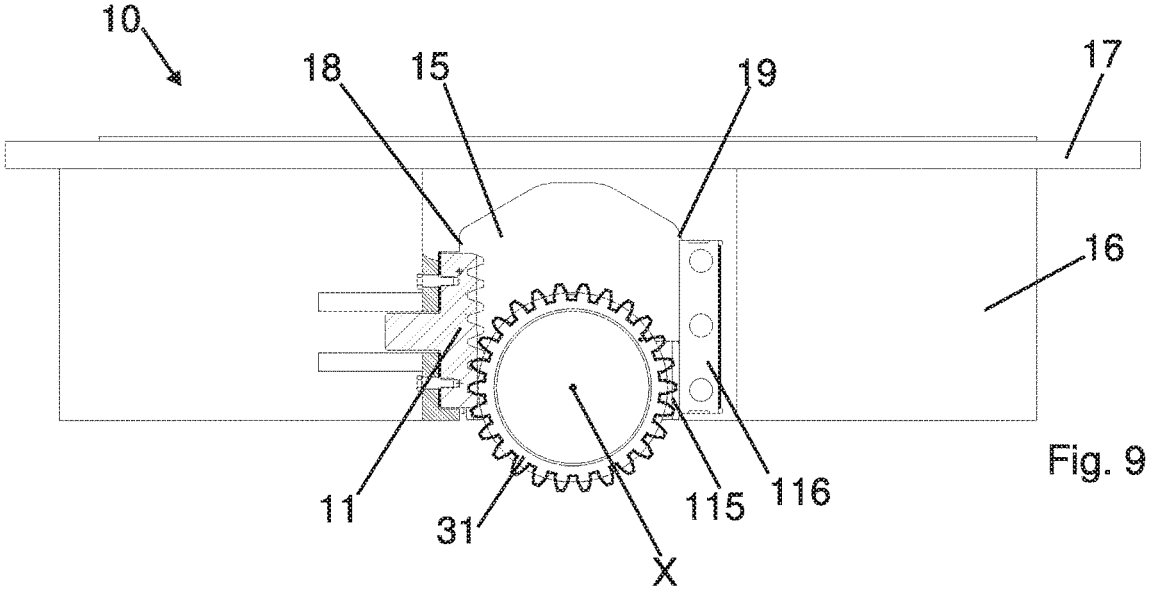

In a first embodiment of the device of the invention shown in FIGS. 7 to 9, the engagement position keeping means comprise:

- a first pair of sliders 116, which are integral with the annular body 10 and parallel to axis Y, and arranged with respect to a plane X-Y, defined by axis Y and by axis X, on opposite walls 18, 19 of a first opening 15 of the annular body 10 crossed by the shaft 21;
- a second pair of sliders 116', which are integral with the annular body 10 and parallel to axis Y, and arranged with respect to the plane X-Y, on opposite walls 18', 19' of a second opening 15' of the annular body 10 crossed by the shaft 22.

The sliders of each pair preferably are mutually symmetrically arranged with respect to plane X-Y.

First opening 15 and second opening 15' are arranged on opposite sides with respect to plane Y-Z, which is orthogonal to plane X-Y, preferably symmetrically arranged with respect to said plane Y-Z.

Preferably, each slider 116, 116' fixed to the annular body 10 advantageously is slidable on a respective fixed guide 115, 115' which is integral with the annular body 60.

The two fixed guides 115 are arranged inside the first opening 15, preferably in symmetrical manner with respect to plane X-Y.

Similarly, the two fixed guides 115' are arranged inside the second opening 15', preferably in symmetrical manner with respect to plane X-Y.

Optionally, each pair of fixed guides 115 or 115' is arranged in proximity of the respective toothed wheel 31, 32, i.e. at an end of the respective shaft 21, 22 which is distal from the transition channel 3.

Preferably, the first pair of fixed guides 115 is externally fixed onto a first tubular support 100 which is coaxial to and outside the shaft 21; while the second pair of fixed guides 115' is externally fixed onto a second tubular support 100' which is coaxial to and outside shaft 22.

The tubular supports 100, 100' are integral with the annular body 60 and preferably symmetrically arranged with respect to plane Y-Z. The tubular supports, for example, can be integrally fixed to or an integral part of the annular body 60.

Figure 2:
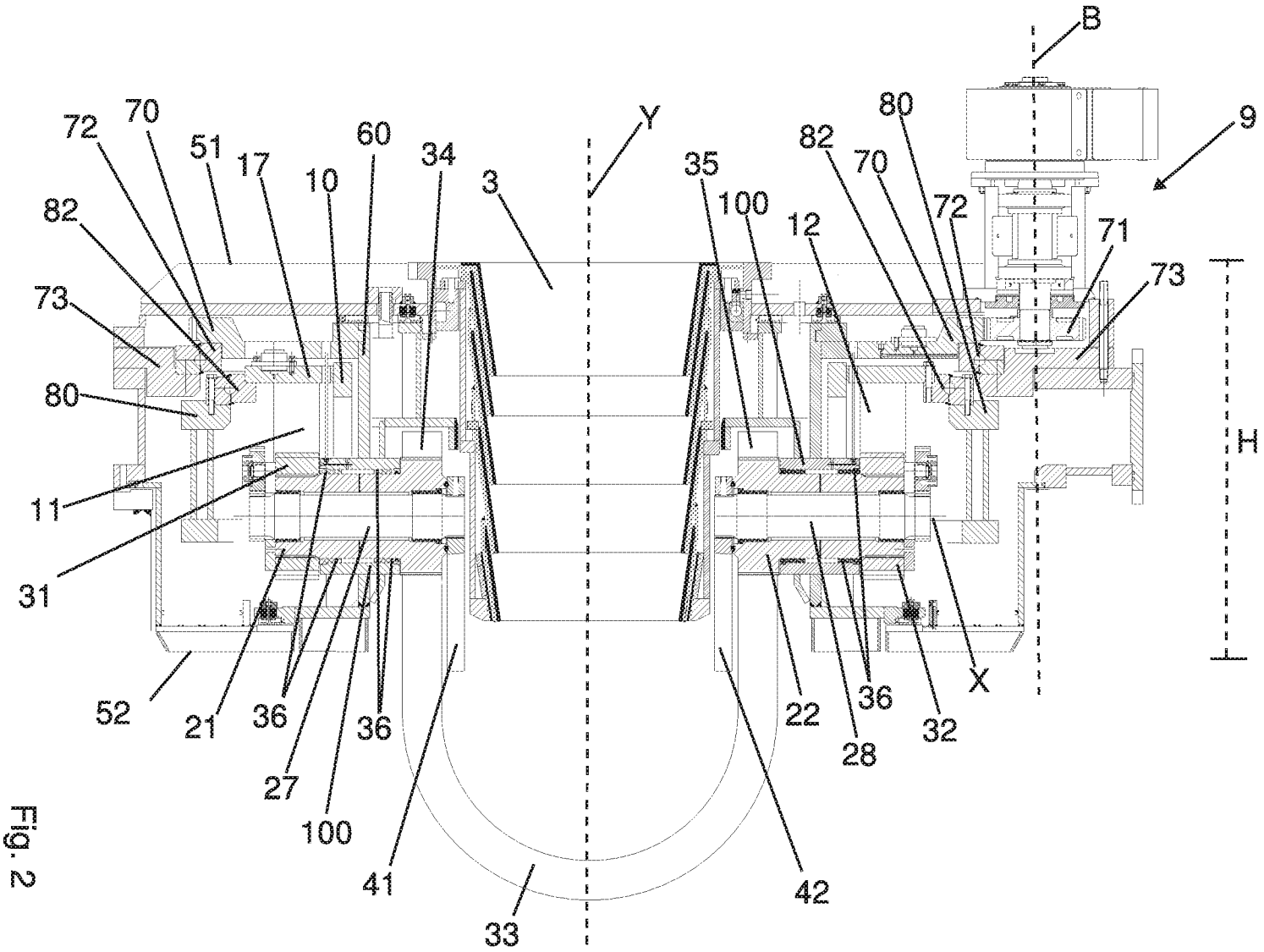
FIG. 2 shows a sectional side view of a part of the device of the invention, rotated with respect to FIG. 1.

Bearings 36, e.g. two bearings, are provided between each tubular support 100, 100' and the respective shaft 21, 22 (as shown in FIG. 2).

With reference to FIG. 1, the longitudinal axis K of chute 5 can form different angles with respect to axis Y.

FIGS. 8 and 9 show two different positions of the annular body 10, to which two different inclinations of chute 5 correspond. The synergy between sliders 116, 116', fixed onto the translating body 10, and the corresponding fixed guides 115, 115', fixed onto the tubular supports 100, 100' which are integral with the annular body 60, keeps the engagement position optimal between the toothed wheels 31, 32 and the respective racks 11, 12.

As can be deduced from FIG. 9, the body 10 and the wheels 31, 32 (only one of the two wheels is shown) are configured, in particular sized, so that the toothed wheels 31, 32 can protrude past the lower edge of body 10 in some operating positions of the device 1.

In the alternative variant (not shown) of this first embodiment which provides only one fixed rack 11 and only one toothed wheel 31, the engagement position keeping means only comprise two sliders 116, which are integral with the annular body 10 and parallel to axis Y, and arranged with respect to plane X-Y, on opposite walls 18, 19 of the first opening 15 of the annular body 10 only, said first opening being crossed by the shaft 21. The two sliders 116 preferably are mutually symmetrically arranged with respect to plane X-Y.

Each slider 116, fixed to the annular body 10, is slidable on a respective fixed guide 115 which is integral with the annular body 60.

The two fixed guides 115 are arranged inside the first opening 15, preferably in symmetrical manner with respect to plane X-Y.

Optionally, the pair of fixed guides 115 is arranged in proximity of the toothed wheel 31, i.e. at an end of the shaft 21 which is distal from the transition channel 3.

Preferably the pair of fixed guides 115 is externally fixed onto a tubular support 100 which is coaxial to and outside the shaft 21.

The tubular support 100 is integral with the annular body 60, for example is integrally fixed to or is an integral part of the annular body 60.

Bearings 36, e.g. two bearings, are provided between the tubular support 100 and the shaft 21.

In a second embodiment of the device of the invention, shown in FIGS. 2 to 6, there are provided:

- a first slider 24 fixed onto a first wall 19 of a first opening 15 of the annular body 10 crossed by the shaft 21;
- a second slider 24' fixed onto a first wall 19' of a second opening 15' of the annular body 10 crossed by the shaft 22;
- a second wall 18 of said first opening 15, opposite to the first wall 19 with respect to plane X-Y defined by axis Y and by axis X, and onto which a first fixed rack 11 is fixed;
- a second wall 18' of said second opening 15', opposite to the first wall 19' with respect to plane X-Y, and onto which a second fixed rack 12 is fixed;
- a first movable rack 13, which is parallel and opposite to the first fixed rack 11, arranged between the first slider 24 and the toothed wheel 31, and engaging with the toothed wheel 31 and being slidable on the first slider 24;
- a second movable rack 14, which is parallel and opposite to the second fixed rack 12, arranged between the second slider 24' and the toothed wheel 32, and engaging with the toothed wheel 32 and being slidable on the second slider 24';

whereby, when the annular body 10 translates along axis Y, the first fixed rack 11 and the second rack 12 rotate the toothed wheel 31 and the toothed wheel 32, respectively, about axis X, which in turn cause the first movable rack 13 and the second movable rack 14, respectively, to slide on the respective sliders 24, 24' in an opposite direction to the translation direction of the annular body 10.

Thus in this second embodiment, the engagement position keeping means comprise, on each side with respect to the transition channel 3 along axis X, a slider 24, 24' directly fixed to the annular body 10 so as to be parallel to and opposite to the respective fixed rack 11, 12, and a movable rack 13, 14 arranged between the respective slider 24, 24' and the respective toothed wheel 31, 32, and engaging the respective toothed wheel 31, 32 on a first side thereof and being slidable on a second side thereof, opposite to the first side, on the respective slider 24, 24'.

The fixed racks 11, 12 are arranged parallel and opposite to the respective movable rack 13, 14. In particular, each fixed rack 11, 12 and the respective movable rack 13 14 are arranged at opposite sides with respect to plane X-Y.

Preferably, the first fixed rack 11 and the second fixed rack 12 are symmetrically arranged with respect to plane Y-Z which is orthogonal to plane X-Y, and also the first movable rack 13 and the second movable rack 14, and also the respective first slider 24 and second slider 24', are mutually symmetrically arranged with respect to plane Y-Z.

With particular reference to FIGS. 3 to 6, each movable rack 13, 14 is coupled to a respective toothed wheel 31, 32 in such a configuration that the toothed wheel 31 is arranged between the fixed rack 11 and the movable rack 13 and engages with both these racks 11, 13, while the toothed wheel 32 is arranged between the fixed rack 12 and the movable rack 14 and engages with both these racks 12, 14.

Each movable rack 13, 14 is restrained to the annular body 10 so as to slide in opposite direction with respect to body 10 when the latter translates along axis Y.

Figure 3:
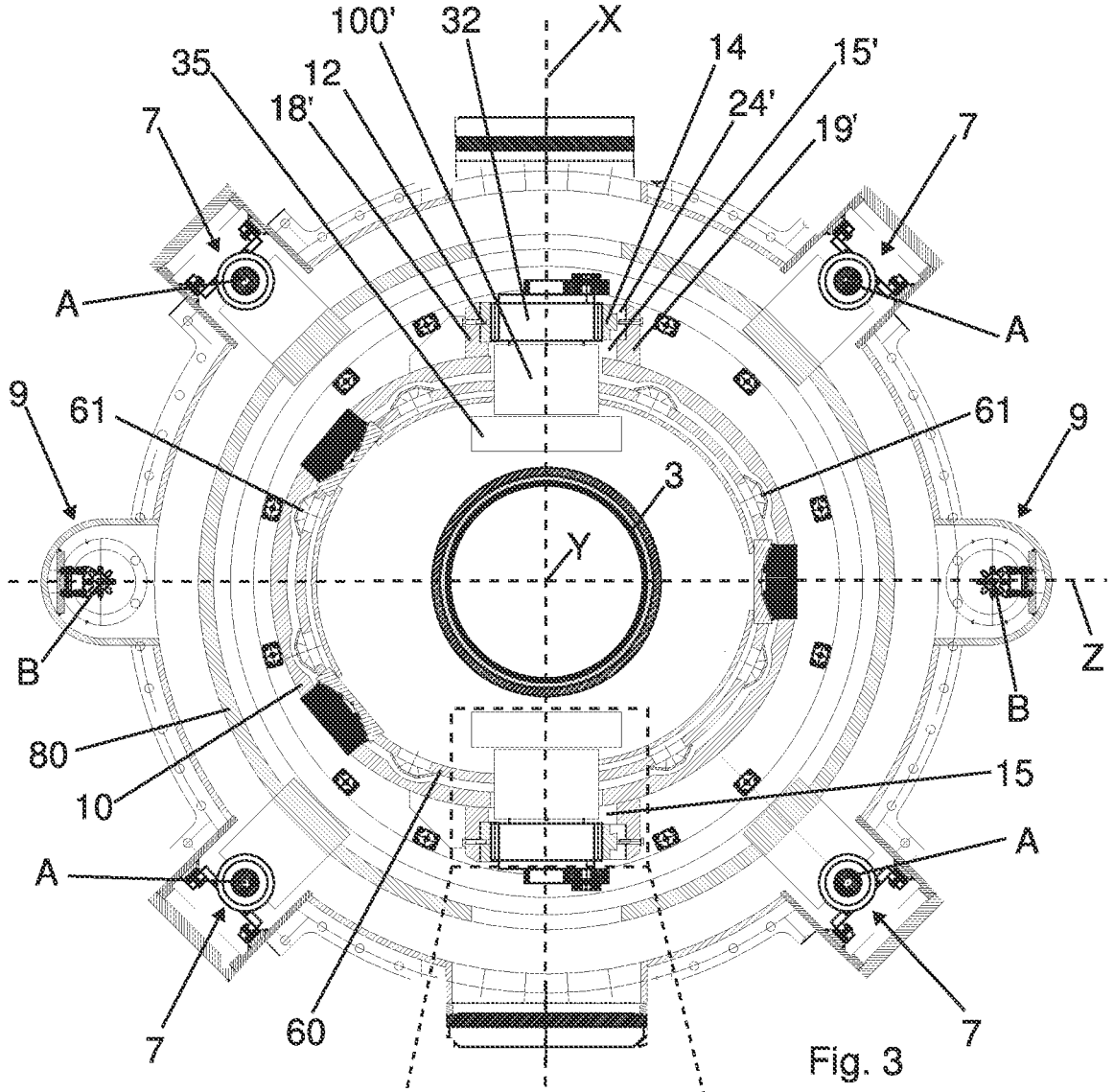
FIG. 3 shows a top sectional view of the device of the invention according to a first embodiment.
Figure 3A:
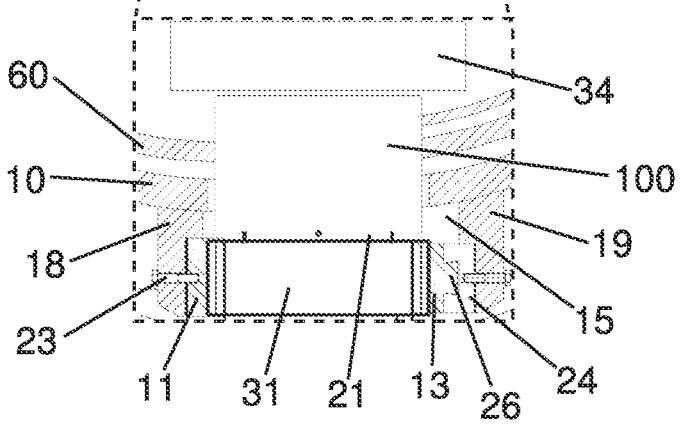
FIG. 3A shows an enlarged detail of FIG. 3.

In particular, the movable rack 13 is slidingly restrained to the slider 24 which is fixed onto the wall 19 so that the rack 13 can only slide parallel to axis Y, thus preventing movements in other directions. In greater detail, the slider 24 (FIG. 3A) preferably is provided with a groove parallel to axis Y. The movable rack 13 comprises a rear protrusion 26 inserted in the groove of the slider 24. Preferably, the rear protrusion 26 is dovetail-shaped, in particular so as to have substantially trapezoid-shaped section, e.g. isosceles trapeze. Preferably, the largest side of such a trapeze is proximal to the wall 19. The groove of the slider 24 has complementary shape to the one of the rear protrusion 26 of the rack 13. The front portion of rack 13, opposite to the rear protrusion 26, comprises the toothed part of rack 13 itself. What is described above similarly applies to the movable rack 14.

When body 10 translates along axis Y, there is a relative motion between the body 10 and the movable racks 13, 14. Body 10 in particular translates in opposite direction with respect to the racks 13, 14. Advantageously, due to the movable racks 13, 14, the perfect contact is ensured between each wheel 31, 32 and the respective fixed rack 11, 12 during the rotation of chute 5 about axis Y.

For descriptive purposes, the racks 11, 12 also are defined fixed racks, in particular with respect to body 10, and the racks 13, 14 are defined movable racks, in particular with respect to body 10.

Figure 4:
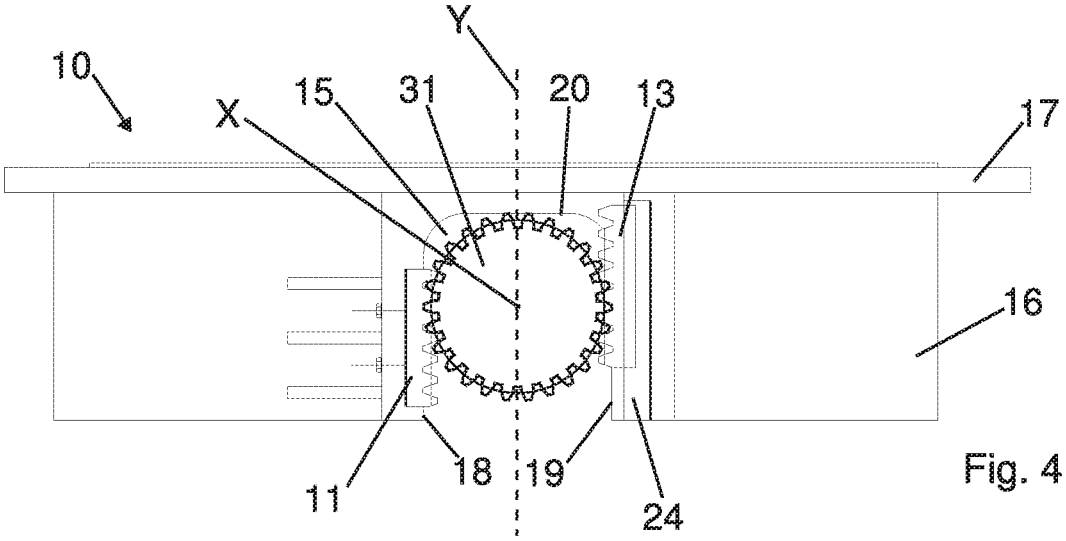
FIGS. 4, 5 and 6 show three different configurations of part of the device of FIG. 3, corresponding to three different positions of the chute.
Figure 5:
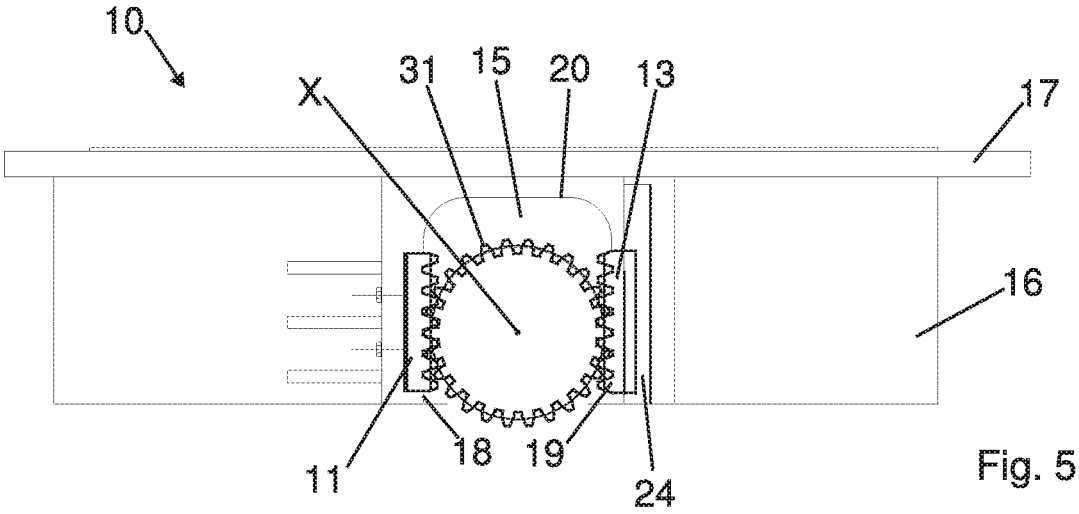
Figure 6:
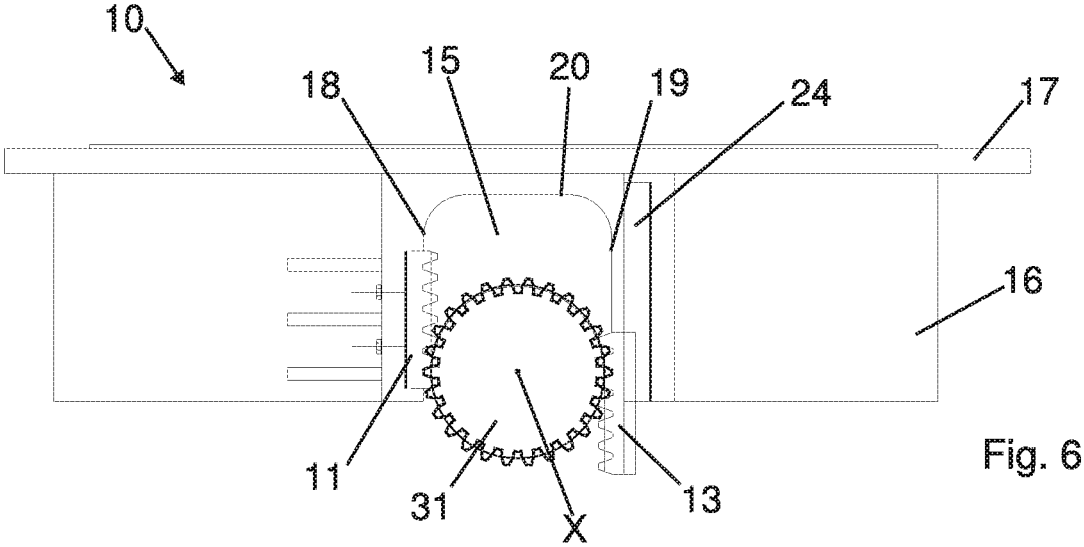

FIGS. 4, 5 and 6 show three different positions of the annular body 10, corresponding to three different positions of chute 5. With reference to FIG. 1, the longitudinal axis K of chute 5 can form various angles with respect to axis Y.

As can be deduced from FIG. 6, the body 10, the movable racks 13, 14 and the wheels 31, 32 are configured, in particular sized, so that the movable racks 13, 14 and/or the toothed wheels 31, 32 can protrude past the lower edge of the body 10 in some operating positions of the device 1.

In the alternative variant (not shown) of this second embodiment which provides only one fixed rack 11 and only one toothed wheel 31, there are provided:

- only one slider 24 which is fixed onto a first wall 19 of a first opening 15 of the annular body 10 crossed by the shaft 21, said slider 24 being parallel to axis Y;
- a second wall 18 of said first opening 15, opposite to the first wall 19 with respect to plane X-Y and onto which the fixed rack 11 is fixed;
- only one movable rack 13, which is parallel and opposite to the fixed rack 11, arranged between the slider 24 and the toothed wheel 31, and engaging with the toothed wheel 31 and being slidable on slider 24, whereby, when the annular body 10 translates along axis Y, the fixed rack 11 rotates the toothed wheel 31 about axis X, which in turn causes the movable rack 13 to slide on the slider 24 in an opposite direction to the translation direction of the annular body 10.

Thus in this alternative variant of the second embodiment, the engagement position keeping means comprise, on only one side with respect to the transition channel 3 along axis X, a slider 24 which is integrally fixed to the annular body 10 so as to be parallel to and opposite to the fixed rack 11, and a movable rack 13 arranged between the slider 24 and the toothed wheel 31, and engaging the toothed wheel 31 on a first side thereof and being slidable on a second side, opposite to the first side, on the slider 24.

The fixed rack 11 is arranged parallel and opposite to the movable rack 13. In particular, the fixed rack 11 and the movable rack 13 are arranged at opposite sides with respect to plane X-Y.

In all the embodiments described above, the annular body 10 surrounds the transition channel 3. In particular, the body 10 is substantially tubular and preferably has a substantially elliptical or circular cross section. Preferably, the body 10 comprises a peripheral flange 17 which radially extends outwards, and is connected to the actuation means 7 by means of the bearing 82 and the annular body 80 (FIG. 1). In particular, the peripheral flange 17 extends from the side wall 16 of the body 10.

The body 10 is provided with two openings 15, 15'. In particular, the openings 15, 15' substantially are recesses or cavities of the side wall 16 of the body 10. The openings 15, 15' are opposite to each other, preferably diametrically opposite to each other, along axis X. Each opening 15, 15' is crossed by a respective shaft 21, 22.

Preferably, the peripheral flange 17 of the body 10 is above the openings 15, 15', i.e. the peripheral flange 17 is distal from the chute 5.

Preferably, the two walls 18, 19 and 18', 19' of each opening 15, 15' (see, for example, FIGS. 3 to 6) can extend outwards from the side wall 16 of the body 10.

The walls 18, 19 and 18', 19' of each pair of walls are spaced apart and opposite to each other, in particular parallel to each other. Moreover, there is provided a wall 20, proximal to the peripheral flange 17, which joins the two walls 18, 19 and 18', 19' and extends transversely, e.g. orthogonal, to plane X-Y.

A respective toothed wheel 31, 32 is arranged between the walls 18, 19 and between the walls 18', 19'.

The rack 11 is integral with the wall 18 of the opening 15, and more generally, it is integral with body 10. In particular, the rack 11 is fixed to the wall 18 by means of fastening means 23, for example, screws and bolts. Similarly, the rack 12 is integral with the respective wall 18' of the opening 15'.

The arrangement of the rack 11 and of the toothed wheel 31 is such that a rotation of the toothed wheel 31 about axis X, which is perpendicular to axis Y, corresponds to a translation of the rack 11, i.e. of the body 10, along axis Y. Similarly for the rack 12 and the toothed wheel 32, if provided.

It is worth noting that during the translation of body 10, the shafts 21, 22 rotate about axis X but do not translate along axis Y.

Each toothed wheel 31, 32, or pinion, preferably, but not necessarily, is provided with a toothing along the whole periphery thereof.

In all the embodiments described above, the actuation means 7, which serve to translate body 10 along axis Y, preferably are hydraulic means, for example one or more hydraulic cylinders.

Each of the actuation means 7 defines a respective axis A (FIGS. 1 and 3), for example a respective longitudinal axis, which is parallel to axis Y. Axis A is the axis along which the movable element, e.g. the piston 74, of each of the actuation means 7 can slide.

When a plurality of actuation means 7 is provided, the arrangement thereof is such that they are angularly spaced apart from one another, in particular with respect to axis Y.

The actuation means 7 can be connected to body 10 in various manners.

With particular reference to FIG. 1, the annular body 10 is preferably connected to the actuation means 7 by means of an annular body 80, which is coaxial to and outside the body 10. In particular, the annular body 80 is integrally connected to the actuation means 7. In greater detail, the annular body 80 is integrally connected to the piston 74 of each actuation means 7. The body 10, in particular the peripheral flange 17 thereof, and the annular body 80 are connected to each other by means of a bearing 82. The bearing 82 allows the body 10 to translate along axis Y together with the annular body 80 under the effect of the actuation means 7. Moreover, the bearing 82 allows the body 10 to rotate about axis Y, and in particular with respect to the annular body 80. By way of example only, a bearing 82, suitable for forming the connection described above, comprises two parts, a first part of which is integrally fixed to the body 10 and a second part of which is integrally fixed to the annular body 80. One part of the bearing 82 can therefore rotate with respect to the other part, about axis Y.

In all the embodiments described above, the actuation means 9 are adapted to rotate the annular bodies 60 and 10, and in particular the shafts 21, 22 and the chute 5 connected to the body 60, together about axis Y.

The actuation means 9 are, for example, one or more electric or hydraulic motors provided with a respective pinion 71. Each pinion 71 is connected to an annular flange 70, or transmission element, which is integrally fixed to the annular body 60, preferably about the body 60. Pinion 71 of the actuation means 9 engages with the periphery of the flange 70. Moreover, the flange 70 is supported by a bearing 72. Bearing 72 in turn is supported on the outer side by an annular support 73 which preferably is fixed to the housing 50 of the device 1.

Thereby, the flange 70 can rotate, by means of the actuation means 9, about axis Y and transmit such a rotation motion to the body 60, which in turn transmits the rotation motion to the body 10.

When a plurality of actuation means 9 is provided, the arrangement thereof is such that they are angularly spaced apart from one another, in particular with respect to axis Y.

Each actuation mean 9 defines a respective axis B, which is the axis about which pinion 71 rotates. Each axis B is parallel to axis Y.

Body 60 and body 10 are restrained to each other so that the body 10 can translate along axis Y with respect to the body 60, and so that, when the body 60 rotates about axis Y, the body 10 rotates together with the body 60, dragged by the latter. To this end, for example, the body 60 is provided with a plurality of protrusions 61 (FIGS. 3 and 7) arranged in corresponding recesses of the body 10.

Moreover, the body 60 supports the shafts 21, 22 by means of the tubular supports 100, 100', which are integral with the body 60.

Preferably, the actuation means 7 and the actuation means 9 are arranged radially outside the bearing 72 and the bearing 82. In particular, axis A of each actuation means 7 and axis B of each actuation means 9 are radially arranged outside both the circumference defined by the bearing 72 and the circumference defined by the bearing 82. Such circumferences preferably are the rolling pitch circles of the rolling bodies of the respective bearing. Advantageously, in light of such an arrangement of the actuation means 7 and of the actuation means 9 with respect to the bearings 72, 82, the barycenter of the delivery device 1 always is within the circumference defined by the bearing 72 and within the circumference defined by the bearing 82 for any position taken on by chute 5.

One of the advantages resulting from keeping the barycenter of the delivery device 1 always within such circumferences consists of a low stress of the components of the device, thus allowing a delivery device with a lengthy operating life to be obtained. In particular, the bearings 72, 82 are not subjected to damaging stresses and a reversal of the loads, which would trigger the pitting phenomenon of the components of device 1, is prevented.

The radially peripheral arrangement of the actuation means 7 and of the actuation means 9 advantageously allows having wide space within the housing 50.

For example, the actuation means 7 and/or the actuation means 9 can be radially separated from the housing 50. In such a case, specific side housings connected to the housing 50 can be provided for the actuation means 7 and/or the actuation means 9.

The space available inside housing 50 allows particularly performing bearings 72, 82 to be used. For example, bearings with a large diameter can be used.

The circumference defined by the bearing 72 and the circumference defined by the bearing 82 are coaxial to axis Y.

Preferably, the rolling pitch diameter of the rolling bodies of bearing 72 is greater than the rolling pitch diameter of the rolling bodies of bearing 82.

In particular, it is preferable for the outer diameter of bearing 72 to be greater than the outer diameter of bearing 82, whereby the bearing 72 is arranged radially outside the bearing 82.

As mentioned above, when two toothed wheels 31, 32 are provided, each toothed wheel 31, 32, or pinion, is fixed to a respective shaft 21, 22.

In all the embodiments described above, the device of the invention can also comprise two further shafts 27, 28, each further shaft 27, 28 being inserted into a respective shaft 21, 22 and integrally fixed thereto.

Each toothed wheel 31, 32 is integrally fixed to a respective outer shaft 21, 22, in particular to the outer surface of the respective outer shaft 21, 22.

Preferably, each wheel 31, 32 is integrally fixed, in particular keyed, to the distal end of the respective outer shaft 21, 22 with respect to the transition channel 3.

Each outer shaft 21, 22 can thus rotate together with the respective wheel 31, 32 about the rotation axis X.

For this purpose, each outer shaft 21, 22 is provided with one or more bearings 36 (FIG. 2) arranged thereabout, whereby each bearing extends about axis X.

The bearings 36 are arranged between the respective outer shaft 21, 22 and the respective tubular support 100, 100'. For example, two pairs of bearings 36 are provided for each outer shaft 21, 22.

There is provided an upper or main support 33 of chute 5 which comprises two end portions 34, 35, each end portion 34, 35 being fixed to a respective shaft 21, 22. Preferably, there are provided two side supports 41, 42 of chute 5, each side support 41, 42 connecting the chute 5 to a respective further shaft 27, 28, or inner shaft. Such side supports 41, 42, which are arranged in the area between said two end portions 34, 35 of the main support 33, keep the chute 5 blocked in position with respect to the main support 33.

Each further shaft 27, 28 comprises one end which is proximal to the transition channel 3 and one end which is distal from the transition channel 3, and preferably each support 41, 42 is fixed to the proximal end of the respective inner shaft 27, 28.

Preferably, the ends of each inner shaft 27, 28 protrude from the respective outer shaft 21, 22. A respective side support 41, 42 of chute 5, for example a respective blocking arm or lever (FIG. 2), is integrally fixed to the proximal end of each inner shaft 27, 28, said end being proximal with respect to chute 5. When the inner shafts 27, 28 are not provided, the side supports 41, 42 preferably are directly fixed to the shafts 21, 22.

Preferably, the two shafts 21, 22 are mutually symmetrically arranged with respect to plane Y-Z. Also the two supports 41, 42 preferably are mutually symmetrically arranged with respect to plane Y-Z.

The two inner shafts 27, 28, when provided, are mutually symmetrically arranged with respect to plane Y-Z.

In the variant shown in FIG. 2, the chute 5 is supported by the upper support 33, which is fixed to the shafts 21 and 22, and by the two side supports 41, 42, preferably two blocking levers, which fix chute 5 in position. Thus, chute 5, upper support 33 and the two side supports 41, 42 constitute four components separate from one another.

Figure 10:
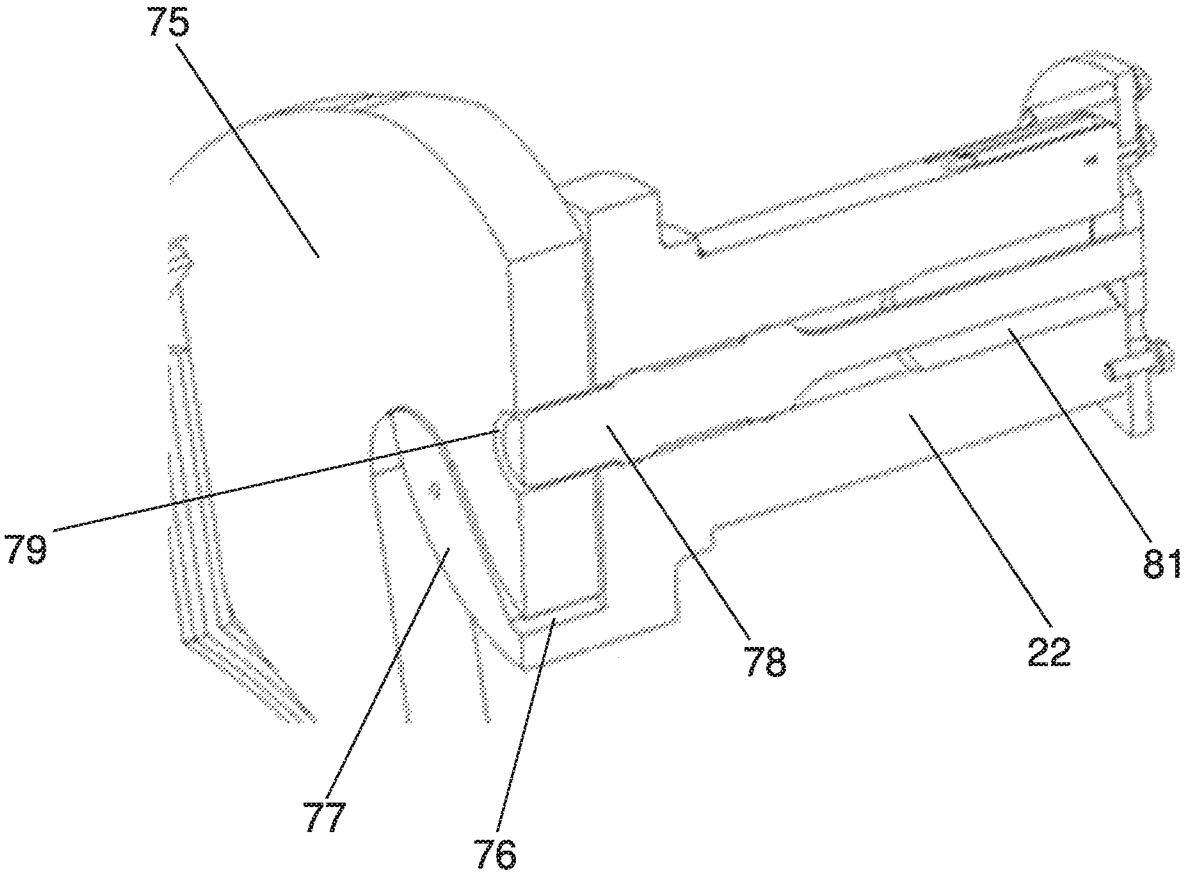
FIG. 10 shows a sectional perspective view of part of the device of the invention in an alternative variant thereof.

In an alternative variant shown in FIG. 10, the use of the upper support 33 is not provided and the chute 5 is provided at an upper end thereof with two flat side protrusions 75, e.g. hook-shaped, which are adapted to engage in a respective notch or recess 76 made on the end surface 77 of the corresponding shaft 21, 22. These end surfaces 77 are at the ends of the shafts 21, 22 which are proximal to the transition channel 3. A safety pin 78 is provided to keep each flat side protrusion 75 of the chute safely blocked in the respective notch or recess 76 of the corresponding shaft 21 22; said safety pin longitudinally crosses, along axis X, an inner cavity 81 of the respective shaft 21, 22 and protruding from the respective end surface 77, crosses a corresponding hole 79 provided in the flat side protrusion 75 of the chute. These safety pins 78 prevent the respective flat side protrusions 75 from coming out of the corresponding notch or recess 76. Thus, in this alternative variant there is a single component, that is the chute 5, in place of the four separate components indicated above.

The device of the invention advantageously can be made with compact dimensions and with a reduced weight. Indeed, the housing 50, i.e. the outer housing, of the device 1 can have, for example, a maximum width, parallel to axis X, which preferably is comprised between 2.5 and 5 m.

Housing 50 advantageously has a very compact height H (FIGS. 1 and 2) along axis Y, preferably less than 1.5 meters.

Such a height H preferably is the distance between an upper surface 51 and a lower surface 52 of housing 50.

Such a height H does not comprise the height of the actuation means 7 and of the rotation means 9, which protrude, at the top, past the upper surface 51 of housing 50.

In particular, the compact height allows the delivery device 1 to be installed on existing blast furnaces without altering the existing components upstream, i.e. above, and downstream, i.e. below, the delivery device 1.

The structure of the device of the invention advantageously also allows the annular body 10 to have compact dimensions so that there is a lot of space available inside housing 50, if required.

Body 10 preferably has a maximum width, parallel to axis X, comprised between 2 and 4 m. Moreover, it is preferable for the wall thickness of the body 10, in particular of the side wall 16 thereof, to be comprised between 2 and 10 mm.

The invention claimed is:

1. A delivery device for delivering stock material into a blast furnace, the delivery device comprising:

a transition channel for the stock material, defining a first axis;

a chute for delivering the stock material, arranged below the transition channel;

a first annular body, coaxial to and outside the transition channel, adapted to rotate about the first axis;

a second annular body, coaxial to and outside the first annular body, adapted to translate along the first axis with respect to said first annular body and/or to rotate about the first axis together with said first annular body;

at least one rack fixed to the second annular body and arranged parallel to the first axis;

two shafts, having a second axis, transversal to said first axis, arranged on opposite sides with respect to the transition channel and crossing said second annular body and said first annular body;

at least one toothed wheel, engaging the at least one rack and fixed to one shaft of said two shafts;

wherein the chute is connected to the two shafts;

whereby, when the second annular body translates along the first axis, the at least one rack rotates the at least one toothed wheel and a respective shaft of said two shafts about the second axis, thus causing a change in an inclination of the chute with respect to the first axis;

wherein there are provided engagement position keeping means, adapted to keep an engagement position of the at least one toothed wheel on the at least one rack during a roto-translation of the second annular body;

wherein said engagement position keeping means are at least partially arranged on said second annular body;

wherein said engagement position keeping means comprise two sliders, which are integral with the second annular body and adapted to oppose a reaction force component, which is orthogonal to said at least one rack, which is generated when said second annular body translates along the first axis;

wherein the two sliders are parallel to the first axis, and arranged with respect to a first plane, defined by the first axis and by the second axis, on opposite walls of a first opening of the second annular body, said first opening being crossed by one shaft of said two shafts;

each of said two sliders being slidable on a respective fixed guide which is integral with the first annular body and arranged inside said first opening.

2. The device according to claim 1, comprising two racks, fixed to the second annular body and arranged on opposite sides with respect to the transition channel;

two toothed wheels, coaxial to each other, each toothed wheel engaging a respective rack of said two racks;

wherein each toothed wheel is fixed to a respective shaft of said two shafts;

whereby, when the second annular body translates along the first axis, the two racks rotate the toothed wheels and said two shafts about the second axis, thus causing a change in the inclination of the chute with respect to the first axis.

3. The device according to claim 2, wherein said two sliders are arranged with respect to the first plane on opposite walls of both a first opening and a second opening of the second annular body, said first opening and said second opening being crossed by a respective shaft of said two shafts and being symmetrically arranged with respect to a second plane which is orthogonal to the first plane; each of said two sliders being slidable on a respective fixed guide which is arranged inside both said first opening and said second opening.

4. The device according to claim 3, wherein there are provided a first pair of fixed guides externally fixed onto a first tubular support which is coaxial to and outside a first shaft of said two shafts;

a second pair of fixed guides externally fixed onto a second tubular support which is coaxial to and outside a second shaft of said two shafts;

wherein there are provided bearings between each tubular support and a respective shaft of said two shafts; and wherein each tubular support is integral with the first annular body.

5. The device according to claim 3, wherein each pair of fixed guides is arranged in proximity of the respective toothed wheel.

6. The device according to claim 3, wherein the two racks are symmetrically arranged with respect to the second plane which is orthogonal to the first plane.

7. The device according to claim 1, wherein the fixed guides are arranged in proximity of the at least one toothed wheel.

8. The device according to claim 7, wherein the two fixed guides are externally fixed onto a tubular support which is coaxial to and outside the shaft, wherein there are provided bearings between said tubular support and said shaft; and wherein said tubular support is integral with the first annular body.

9. The device according to claim 1, wherein there are provided first actuation means, adapted to rotate the first annular body about the first axis, and second actuation means adapted to translate the second annular body along the first axis;

wherein there is provided a third annular body which is coaxial to and outside the second annular body, connected to the second actuation means, adapted to translate along the first axis; wherein the second annular body is connected to the third annular body by means of a first bearing which is coaxial to the first axis and defines a first circumference; wherein the second actuation means define a respective third axis parallel to the first axis; wherein the first actuation means define a respective fourth axis parallel to the first axis; and wherein the third axis and the fourth axis are arranged radially outside the first circumference.

10. The device according to claim 9, wherein there is provided a transmission element which is connected to the first actuation means, externally coaxial and integrally fixed to the first annular body, so as to transmit a rotation to said first annular body; said transmission element being supported by a second bearing which defines a second circumference coaxial to the first axis, and wherein the third axis and the fourth axis are arranged radially outside said second circumference.

11. The device according to claim 1, wherein the first annular body has an outer side surface provided with a plurality of longitudinal protrusions which are parallel to the first axis, and the second annular body has an inner side surface provided with a plurality of longitudinal grooves which are parallel to the first axis, each of said longitudinal grooves being adapted to accommodate a respective longitudinal protrusion, so that the first annular body can rotate the second annular body.

12. The device according to claim 1, wherein two further shafts are provided, each further shaft being inserted into a respective shaft and fixed thereto.

13. The device according to claim 12, wherein two side supports are provided, each side support connecting the chute to a respective further shaft, wherein each further shaft comprises one end which is proximal to the transition channel and one end which is distal from the transition channel, and each support is fixed to the proximal end of the respective further shaft.

14. The device according to claim 1, wherein the chute is provided at an upper end thereof with two flat side protrusions engaged in a respective notch or recess made on an end surface of the corresponding shaft; and wherein two safety pins are provided, each safety pin longitudinally crossing along the second axis an inner cavity of a respective shaft of said two shafts and, protruding from the respective end surface, crosses a hole provided in the corresponding flat side protrusion of the chute.

15. The device according to claim 1, comprising only one rack fixed to the second annular body and arranged parallel to the first axis at only one side, along the second axis, with respect to the transition channel;

only one toothed wheel, engaging the rack and fixed to one shaft of said two shafts;

whereby, when the second annular body translates along the first axis, the rack rotates the toothed wheel and a respective shaft of said two shafts about the second axis, thus causing a change in the inclination of the chute with respect to the first axis.

16. A delivery device for delivering stock material into a blast furnace, the delivery device comprising a transition channel for the stock material, defining a first axis;

a chute for delivering the stock material, arranged below the transition channel;

a first annular body, coaxial to and outside the transition channel, adapted to rotate about the first axis;

a second annular body, coaxial to and outside the first annular body, adapted to translate along the first axis with respect to said first annular body and/or to rotate about the first axis together with said first annular body;

at least one rack fixed to the second annular body and arranged parallel to the first axis;

two shafts, having a second axis, transversal to said first axis, arranged on opposite sides with respect to the transition channel and crossing said second annular body and said first annular body;

at least one toothed wheel, engaging the at least one rack and fixed to one shaft of said two shafts;

wherein the chute is connected to the two shafts;

whereby, when the second annular body translates along the first axis, the at least one rack rotates the at least one toothed wheel and a respective shaft of said two shafts about the second axis, thus causing a change in the inclination of the chute with respect to the first axis;

wherein there are provided engagement position keeping means, adapted to keep the engagement position of the at least one toothed wheel on the at least one rack during a roto-translation of the second annular body;

wherein said engagement position keeping means are at least partially arranged on said second annular body;

wherein said engagement position keeping means comprise at least one slider, which is integral with the second annular body and adapted to oppose a reaction force component, which is orthogonal to said at least one rack, which is generated when said second annular body translates along the first axis;

wherein said engagement position keeping means comprise said at least one slider, which is integrally fixed to the second annular body so as to be parallel to and opposite to the at least one rack, and a movable rack arranged between the at least one slider and the at least one toothed wheel, and engaging the at least one toothed wheel on a first side thereof and being slidable on a second side, opposite to the first side, on the at least one slider.

17. The device according to claim 16, comprising two racks, fixed to the second annular body and arranged on opposite sides with respect to the transition channel;

two toothed wheels, coaxial to each other, each toothed wheel engaging a respective rack of said two racks;

wherein each toothed wheel is fixed to a respective shaft of said two shafts;

whereby, when the second annular body translates along the first axis, the two racks rotate the toothed wheels and said two shafts about the second axis, thus causing a change in the inclination of the chute with respect to the first axis.

18. The device according to claim 16, wherein there is provided only one rack, arranged at only one side with respect to the transition channel along the second axis; and wherein said engagement position keeping means comprise only one slider, integrally fixed to the second annular body and parallel to and opposite to the rack, and a movable rack arranged between the slider and the toothed wheel, engaging the toothed wheel with a first side thereof and being slidable on the slider with a second side thereof opposite the first side, whereby, when the second annular body translates along the first axis, the rack rotates the toothed wheel about the second axis, which in turn causes the movable rack to slide on the slider in an opposite direction to a translation direction of the second annular body.

* * * * *